US008701830B2

(12) United States Patent
Merey

(10) Patent No.: US 8,701,830 B2
(45) Date of Patent: Apr. 22, 2014

(54) FOLDING STEP LADDER

(76) Inventor: Thomas G. B. Merey, Port Hope (CA)

( * ) Notice: Subject to any disclaimer, the term of this patent is extended or adjusted under 35 U.S.C. 154(b) by 0 days.

(21) Appl. No.: 12/926,388

(22) Filed: Nov. 15, 2010

(65) Prior Publication Data

US 2011/0114419 A1 May 19, 2011

(30) Foreign Application Priority Data

Nov. 16, 2009 (CA) ..... 2685645

(51) Int. Cl.
*E06C 1/00* (2006.01)

(52) U.S. Cl.
USPC .... 182/152; 108/92; 297/423.14; 297/423.41

(58) Field of Classification Search
USPC ..... 182/152, 33, 156, 159; D25/65, 63; 297/423.39, 423.41, 423.14, 175, 17, 297/16.1; 108/115, 124, 92; 52/183
See application file for complete search history.

(56) References Cited

U.S. PATENT DOCUMENTS 1,125,194 A * 1/1915 Sigmund ..... 108/100
1,811,674 A * 6/1931 Longley ..... 108/171
2,043,669 A * 6/1936 Liska ..... 297/187
3,346,317 A * 10/1967 Peggs ..... 312/258
3,564,790 A * 2/1971 Rehfeld ..... 52/183
4,533,179 A * 8/1985 Nichols et al. ..... 297/440.12
4,630,861 A * 12/1986 Henschel ..... 297/44
5,562,050 A * 10/1996 Colquhoun ..... 108/115
D460,566 S * 7/2002 Henschel et al. ..... D25/65
6,926,119 B1 * 8/2005 Schrock ..... 182/33
D566,856 S * 4/2008 Eveleth ..... D25/65
D577,833 S * 9/2008 Eveleth ..... D25/65
D579,680 S * 11/2008 Emert ..... D6/353
D586,923 S * 2/2009 Eveleth ..... D25/65
7,905,184 B2 * 3/2011 Eveleth ..... 108/115
D644,032 S * 8/2011 Eveleth ..... D6/353
8,146,518 B2 * 4/2012 Eveleth ..... 108/115
2008/0078309 A1 * 4/2008 Eveleth ..... 108/115
2011/0067608 A1 * 3/2011 Eveleth ..... 108/115

* cited by examiner

*Primary Examiner* — Charles A Fox
*Assistant Examiner* — Kristine Florio

(57) ABSTRACT

The folding step ladder has lower and upper treads and lower and upper risers which are pivotal relative to the treads. The ladder also has front and back side panels on each side of the treads. The side panels on each side are pivotal relative to each other. The lower riser is pivotal relative to the lower tread and to both of the front side panels. A rear panel is pivotal relative to both of the back side panels and the upper tread. When the step ladder is closed or folded and one of its components is lifted, gravity causes the step ladder to open or to unfold. When another of its components is lifted while the step ladder is open or unfolded, gravity causes the step ladder to close or to fold. Handles are provided on the two components to facilitate lifting of them.

17 Claims, 9 Drawing Sheets

Fig.3
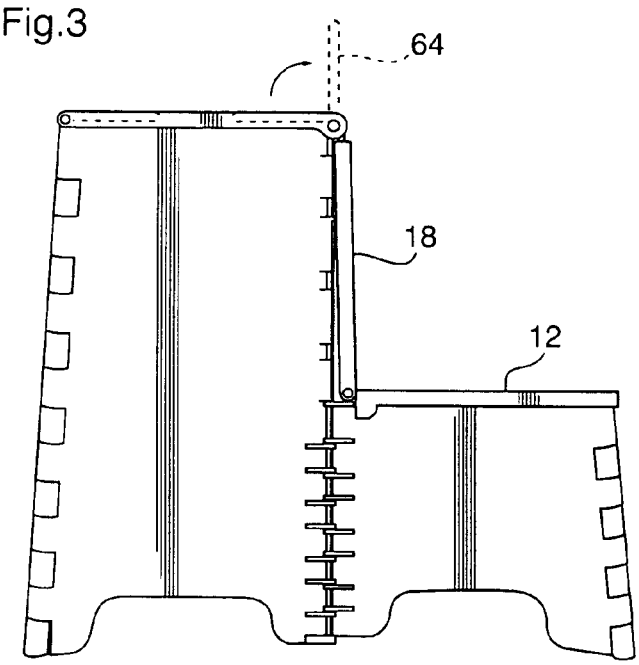
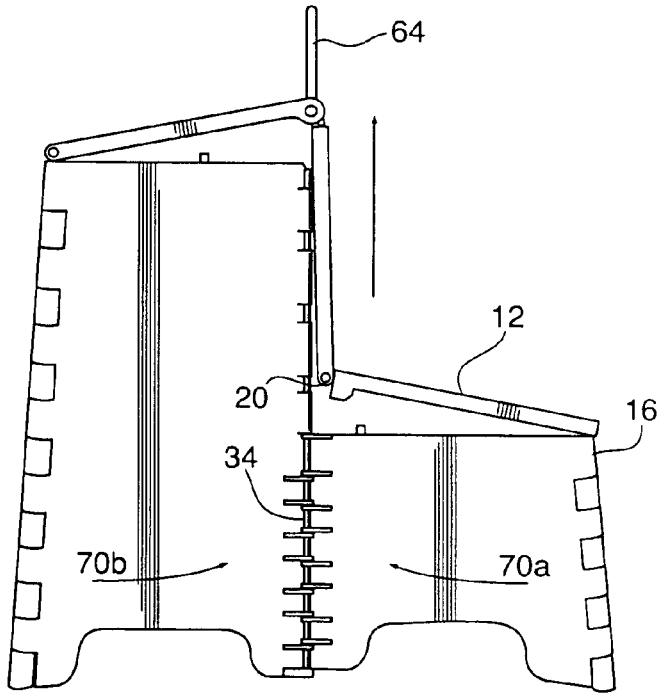
Fig.4

Fig.12
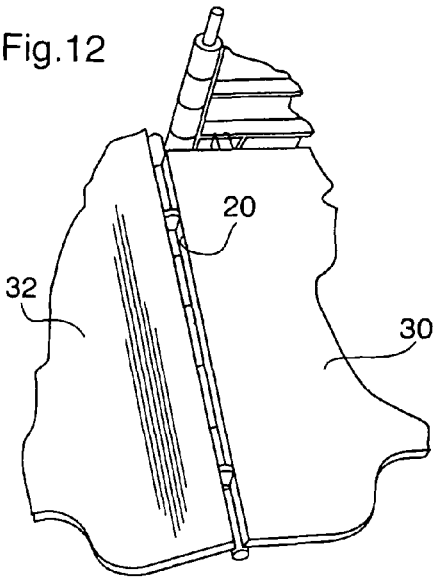
Fig.13
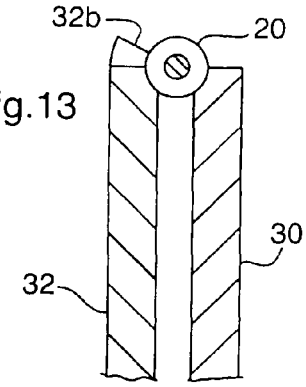
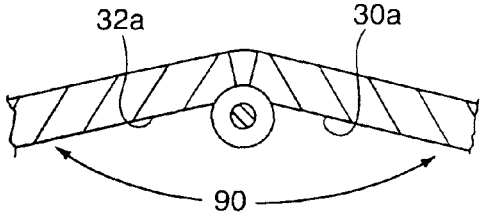
Fig.14
Fig.15
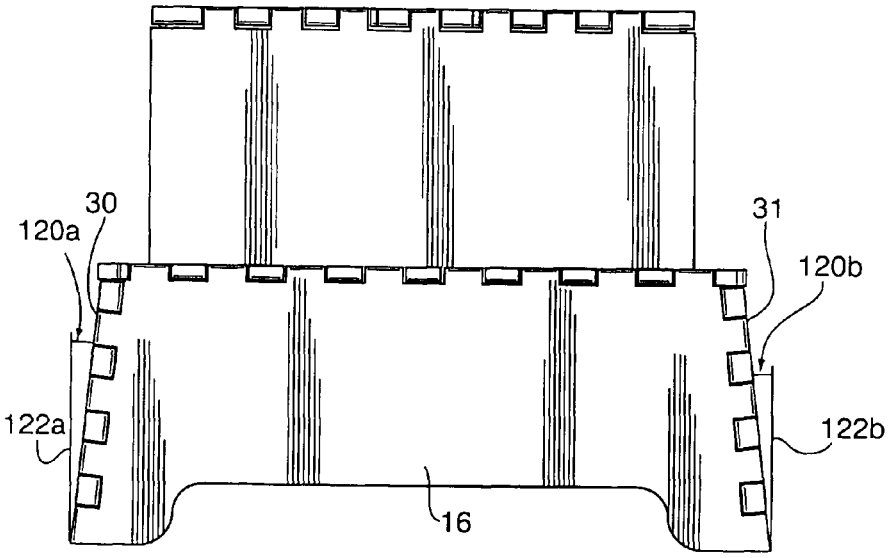

FOLDING STEP LADDER

This application claims priority pursuant to 35 U.S.C. 119 of Canadian application No. 2,685,645, filed Nov. 16, 2009, the entire contents of which are hereby incorporated by reference in their entirety.

FIELD OF THE INVENTION

This invention relates to step ladders and more particularly to a step ladder in which gravity causes it to both unfold for use and to fold compactly for storage.

BACKGROUND OF THE INVENTION

Folding step ladders although generally less stable and sturdy than non-folding ladders are generally preferred where space is at a premium. Folding step ladders have the advantage over non-folding ladders in that they fold into a space small enough to fit into closets and other storage areas where they do not occupy space that is needed for other purposes. Such step ladders however have a number of shortcomings. A particularly irksome shortcoming of many is that they are awkward to fold and unfold. Folding and unfolding of such step ladders involves turning them upside down and pulling the front feet from the back feet. If the feet stick, they may be pulled too hard and the frames may bend. Once bent, the step ladders are usually no longer stable and are unsafe to stand on.

More recent folding step ladders have handles which, when lifted, cause the ladders to unfold for use from a folded position. However such step ladders are not safe for use until additional measures are carried out to ensure that they do not collapse or wobble when weight is placed on them. Those measures usually require the use of two hands and significant prodding, and pushing of the frame. Such measures are highly inconvenient when the step ladders are used in cramped quarters or when they must be folded and unfolded frequently as they are moved from one working area to another.

I have invented a folding step which alleviates these and many other problems of known step ladders. When the step ladder is folded and one of its components is lifted, gravity causes the step ladder to open or to unfold. When another of its components is lifted while the step ladder is open or unfolded, gravity causes the step ladder to close or to fold. Handles are provided on the two components to facilitate lifting of them.

Only one hand is normally required to lift the handles. In most cases, when the handle which causes the step ladder to open is lifted, gravity causes the ladder to completely open and no more measures are required to prepare the step ladder for use. Similarly, when the other handle is lifted, the step ladder closes completely and is ready for storage. No more measures are required to make it so.

The handles the handles are useful not only for opening and closing the step ladder but also to carry the step ladder in a fully open condition or in a closed condition.

SUMMARY OF THE INVENTION

Briefly, the folding step ladder of my invention includes lower and upper treads and lower and upper risers which extend between the treads and are pivotal relative to the treads. The ladder also includes front and back side panels extending downward from opposite sides of the lower and upper treads respectively. The side panels on each side of the treads are pivotal relative to each other. The lower riser is pivotal relative to the lower tread and to both of the front side panels. A rear panel is pivotal relative to the upper tread and extends downward therefrom. The rear panel is pivotal relative to both of the back side panels.

DESCRIPTION OF THE DRAWINGS

The step ladder of the invention is described with reference to the accompanying drawings in which:

FIGS. 3 to 6 are elevations of the step ladder as it is being folded or closed into an inoperative condition from an operative condition;

FIG. 12 is a fragmentary perspective view of the underside of the step ladder;

FIG. 13 is a section of side panels on one side of the step ladder when the ladder is in an inoperative condition;

FIG. 14 is a section of side panels on one side of the step ladder when the ladder is in an operative condition; and FIG. 15 is a front elevation of the step ladder in an operative or open condition.

Like reference characters refer to like parts throughout the description of the drawings.

DESCRIPTION OF PREFERRED EMBODIMENTS

Figure 1:
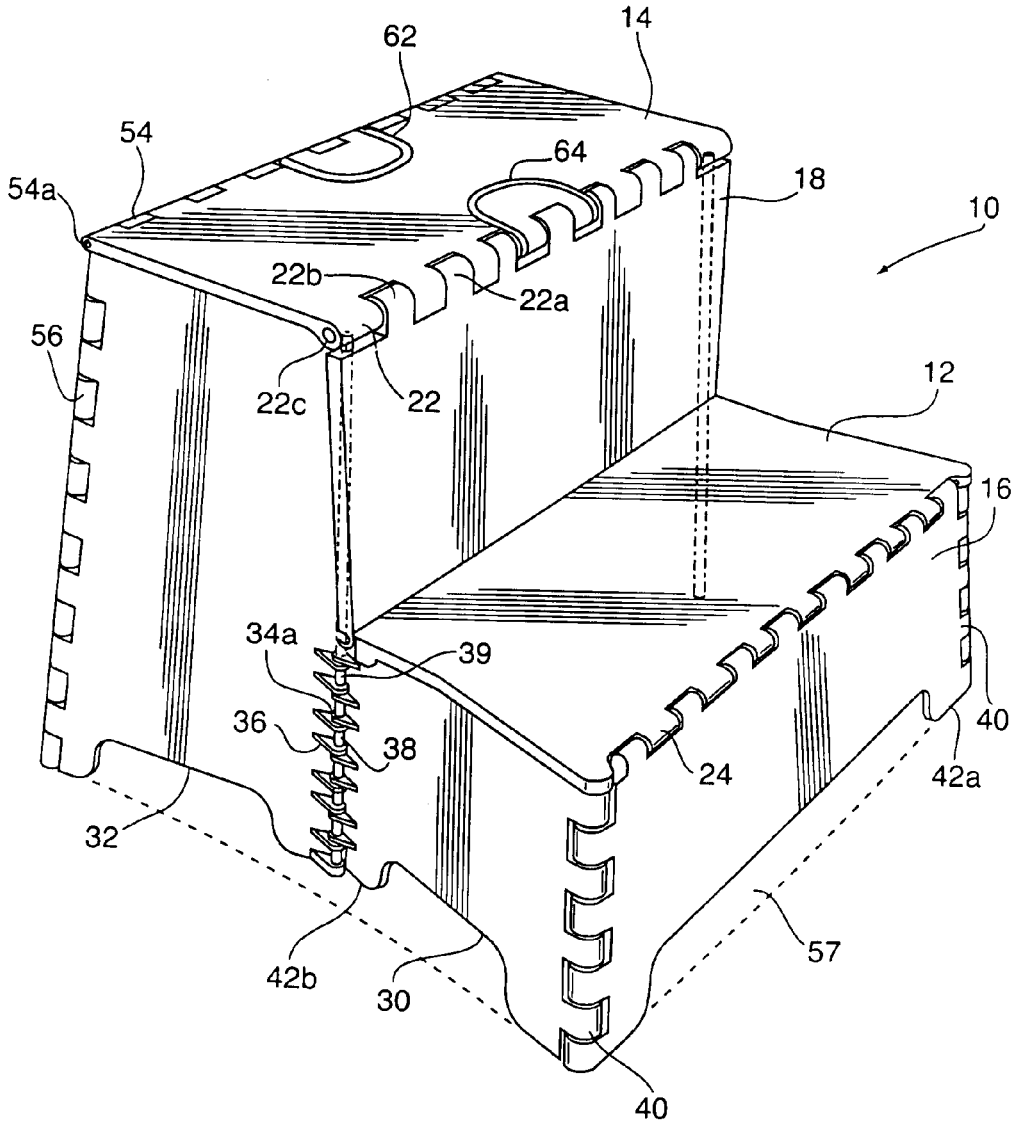
FIG. 1 is a perspective view of the step ladder in an operative or open condition.
Figure 2:
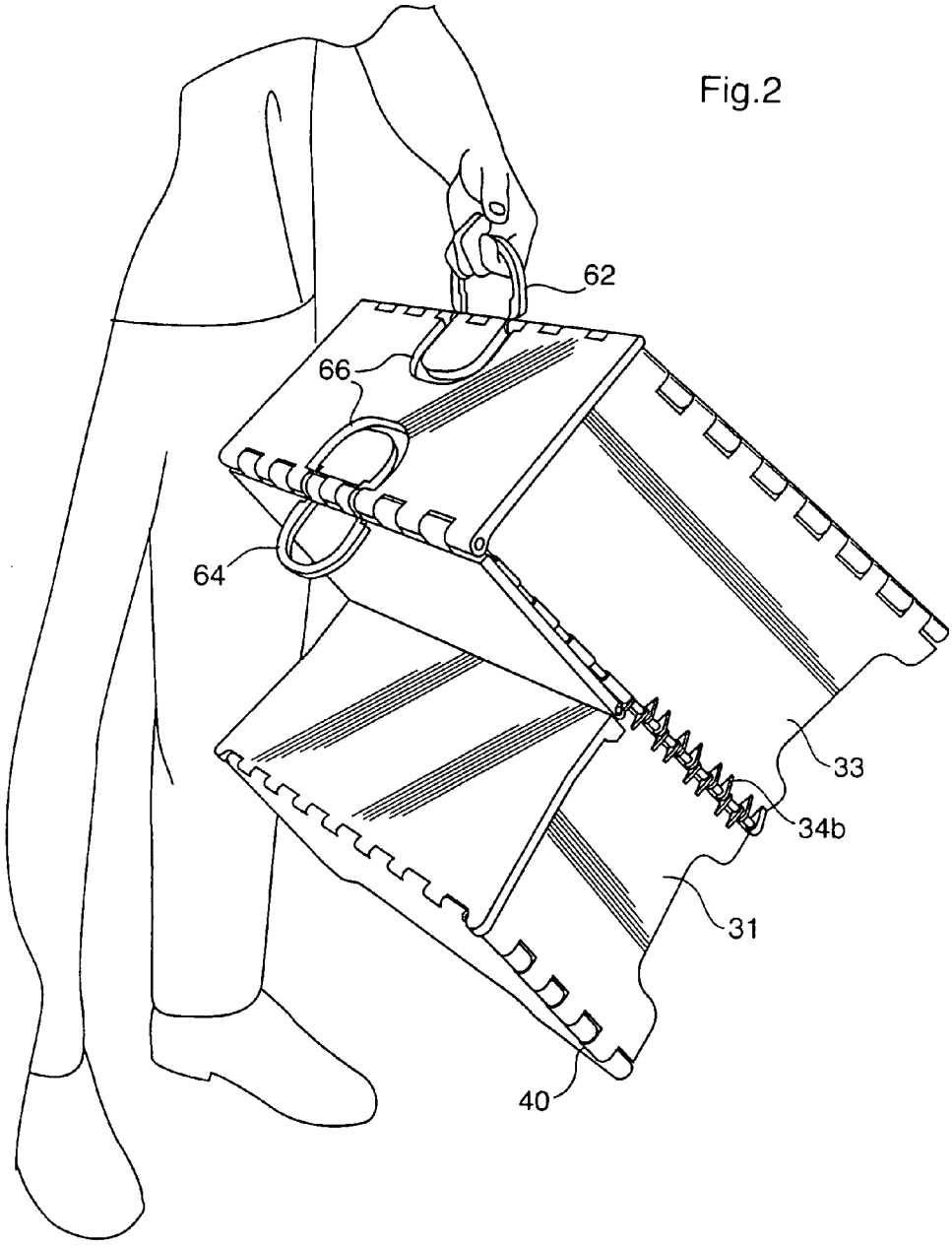
FIG. 2 is a perspective view of the step ladder being carried in an operative condition.
Figure 11:
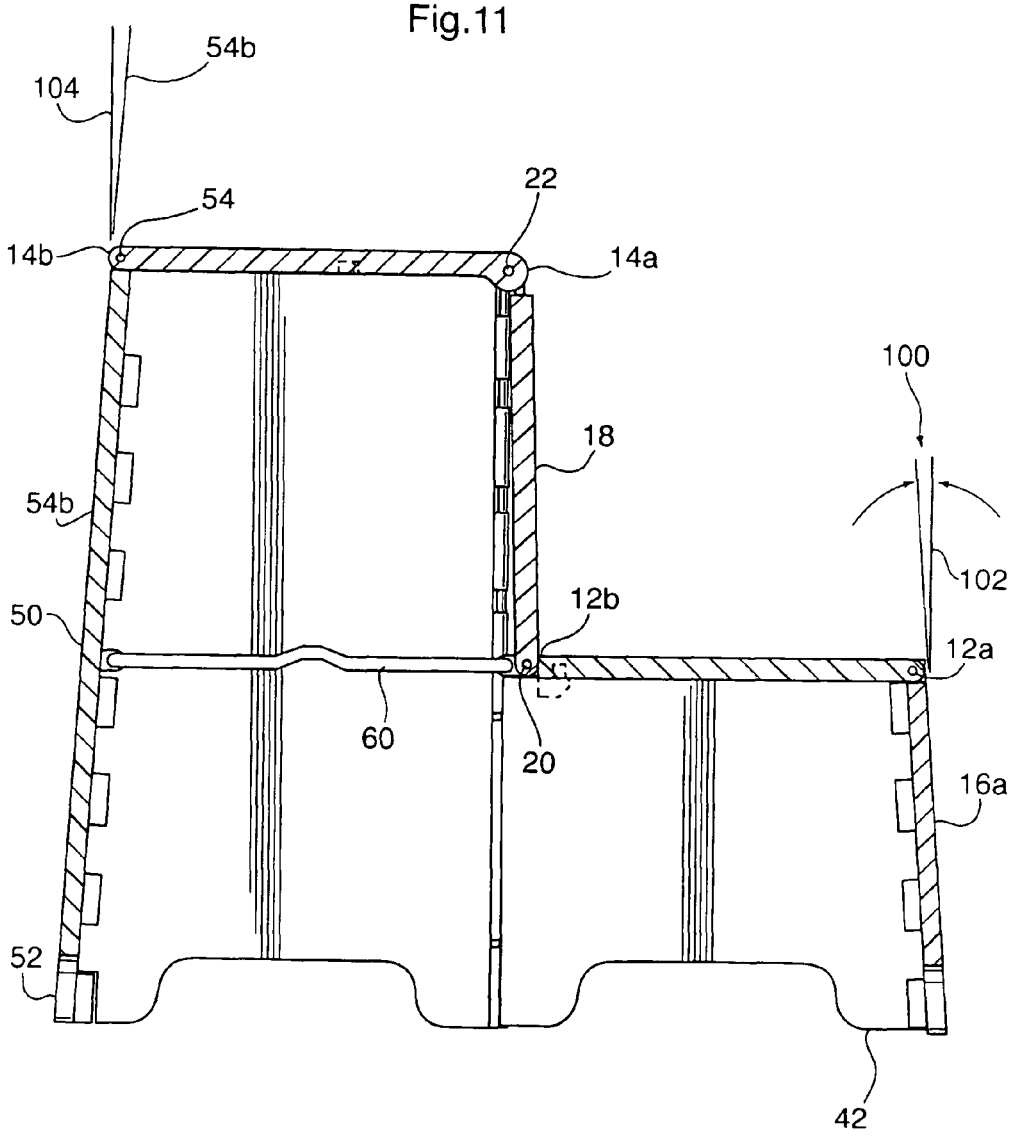
FIG. 11 is an elevation from a side of the step ladder in an operative condition.

With reference to FIGS. 1, 2 and 11, the folding step ladder of the invention, generally 10, includes lower and upper horizontal treads, 12, 14 and lower and upper risers 16, 18. The lower riser extends vertically downward from the lower tread to the surface on which the step ladder rests while the upper riser extends vertically between the two treads. The lower edge of the upper riser is connected to the rear edge 12*b* of the lower tread by means of a hinge 20 and the upper edge of the upper riser is connected to the front edge 14*a* of the upper tread by means of a hinge 22.

As illustrated in FIG. 11, the upper walls of the lower and upper treads should preferably be horizontal for the convenience and expectation of a user of the step ladder.

Hinge 22 is made up of two or more cylindrical tubes or barrels 22*a* spaced along the front edge 14*a* of the upper tread. Like tubes or barrels 22*b* are formed along the upper edge of the upper riser and are located in the space between adjacent tubes or barrels 22*a*. An elongated rod 22*c* extends through the passageways in the tubes and barrels. All other hinges in the step ladder are of the same construction with the exception of those which interconnect the side panels of the step ladder. The latter hinges are described below.

The front edge 12*a* of the lower tread is connected to riser 16 by means of a hinge 24. The tread rests upon but is disconnected to front side panels 30, 31 which extend downward from opposite side edges of the tread. Similarly, the upper tread rests upon but is disconnected to back side panels 32, 33 on opposite side edges of the latter tread.

The front and back side panels on each side of the step ladder are interconnected by hinges 34*a,b*. The hinges are each composed of a number of vertically spaced ears 38 which extend outward from the adjacent edges of the front and back side panels. Aligned openings are formed in the ears for receipt of a rod 39.

The front side panels on opposite side edges of the lower riser are also connected to the latter riser by means of hinges 40. Feet 42*a,b* are formed on the lower riser as well as on the side panels for supporting the front and sides of the step ladder.

A rear panel 50 extends downward from the rear edge of the upper tread and the latter panel is provided with feet 52 for supporting the back of the step ladder. Hinges 54, 56 interconnect the rear panel to the upper tread and back side panels respectively. As illustrated in FIG. 1, the step ladder has a footprint 57 defined by feet 42*a,b* and 52.

A strut 60 extends between the rear panel and the lower edge of the upper riser 18. Opposite ends of the strut are pivotally attached to the riser and to the rear panel at a location at which the strut is generally horizontal when the step ladder is in an operative condition as illustrated in FIG. 11. The strut functions to maintain the upper riser and rear panel in a spaced relationship when the step ladder is in an operative condition.

The step ladder is in an operative condition in FIGS. 1, 2 and 11 and will remain in that condition when carried by means of a handle 62. The handle is pivotally attached to rod 54*a*, a component of hinge 54. The handle is accordingly at a location at which the upper tread 14 pivots about rear panel 50. The handle is sometimes referred to below as a "rear elevating means" and has a dual function, first, for carrying the step ladder when it in an operative condition as described above and illustrated in FIG. 2, and secondly, for causing the step ladder, when in an inoperative condition, to unfold or to open to an operative condition. The latter function of the handle is described below.

Handle 62 is located at the rear edge 14*b* of the upper tread. A second handle 64 is provided at the front edge 14*a* of the upper tread. Both handles when not in use are accommodated in recesses 66 formed in the upper tread.

Handle 64 is pivotally attached to rod 22*c*, a component of hinge 22 and is at a location at which the upper tread 14 pivots about upper riser 18. This handle is sometimes referred to below as a "forward elevating means" and functions to cause the step ladder to fold to an inoperative condition from the operative condition illustrated in FIG. 11.

Figure 5:
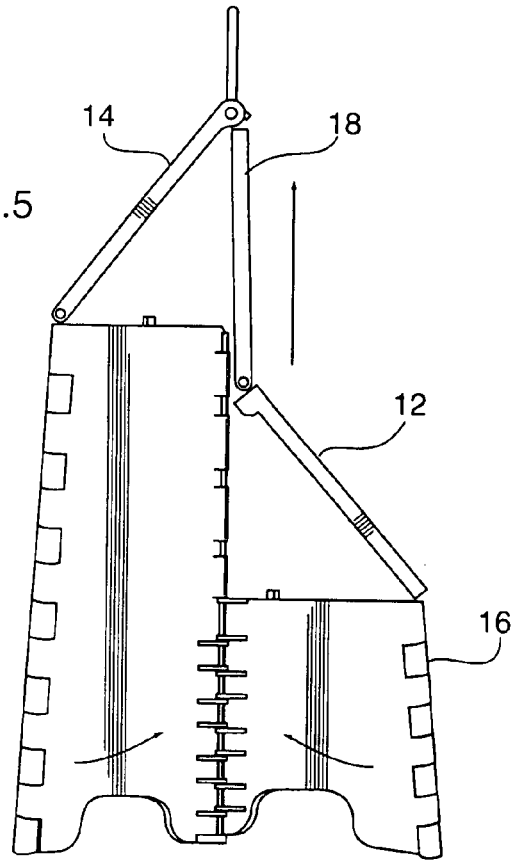

The manner in which the step ladder folds to an inoperative condition is illustrated in FIGS. 3-6. With reference first to FIGS. 3-5, lifting of handle 64 causes upper riser 18 to rise and as it does, so too does hinge 20 with resulting clockwise pivoting of the lower tread 12. Gravity causes the lower riser 16 to swing to the rear in the direction of arrow 70*a*. As the lower riser swings, the front and back side panels pivot inward about hinge 34 in the direction of arrows 70*a,b*.

Lifting of the handle also causes the upper tread to pivot counterclockwise with resulting swinging of the rear panel to the front in the direction of arrow 70*b*.

Figure 6:
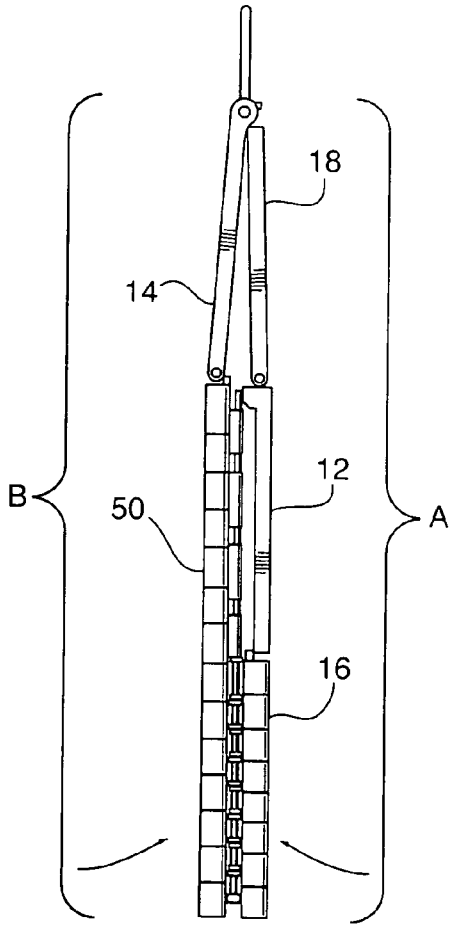

Further lifting of the handle completes the folding of the step ladder to an inoperative condition as illustrated in FIG. 6. In that condition, the upper riser 18, lower tread 12 and lower riser 16 form one substantially linear component, generally "A", while the upper tread 14 and rear panel 50 form a second substantially linear component, generally "B". The width of the upper and lower risers and the lower tread which make up component A should preferably be substantially equal to the width of the upper tread and the length of the rear panel. The term "width" refers to the distance between the front and back edges of the risers and treads while "length" refers to the distance between the upper edge of the rear panel and its lower edge.

Figure 10:
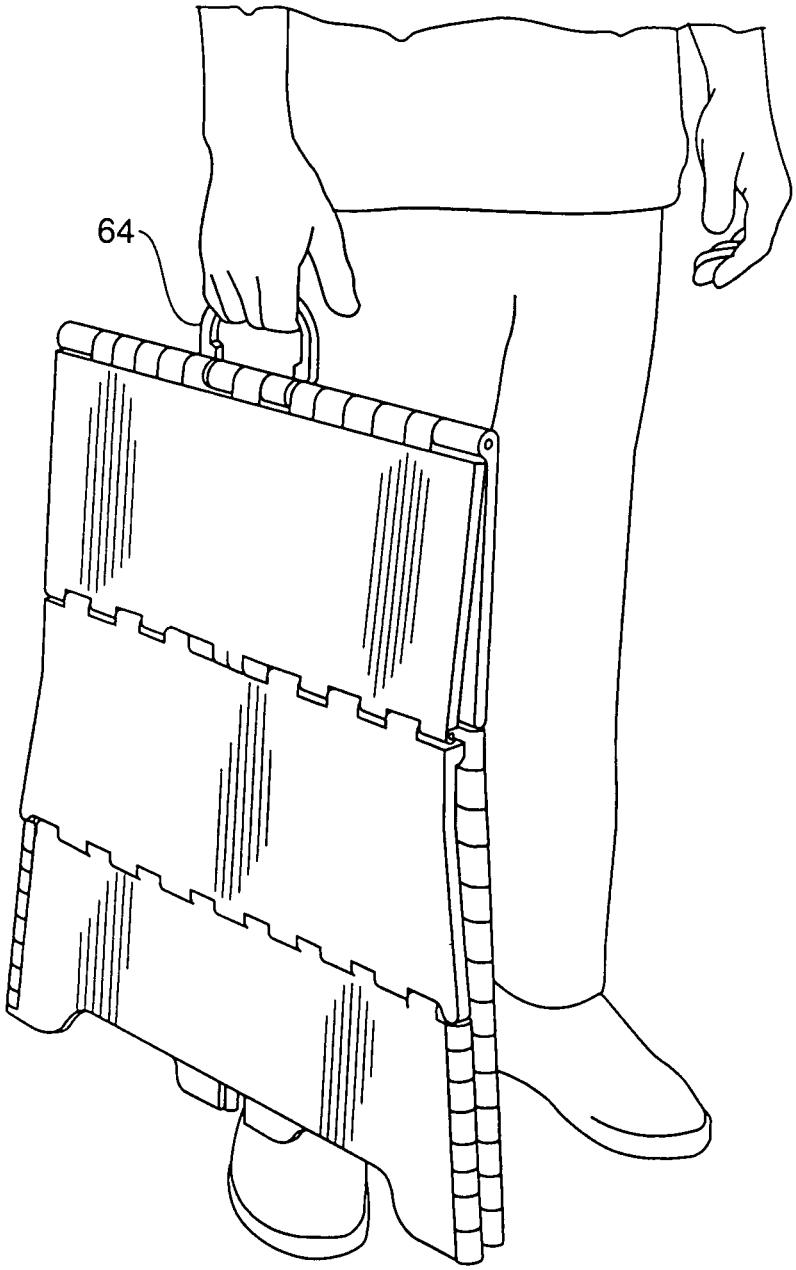
FIG. 10 is an elevation of the step ladder in an inoperative condition being carried.

As illustrated in FIG. 6, the two components A,B are substantially parallel and are adjacent to each other. The step ladder will remain in an inoperative condition when carried by handle 64 as illustrated in FIG. 10.

Figure 7:
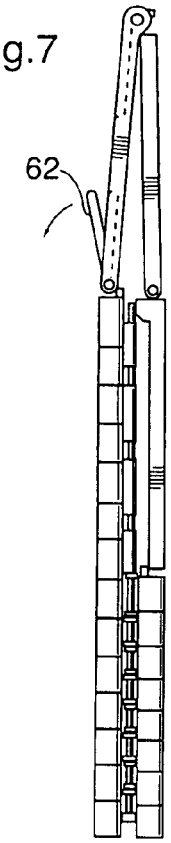
FIGS. 7 to 9 are elevations of the step ladder as it is being unfolded or opened from an inoperative condition to an operative condition.
Figure 8:
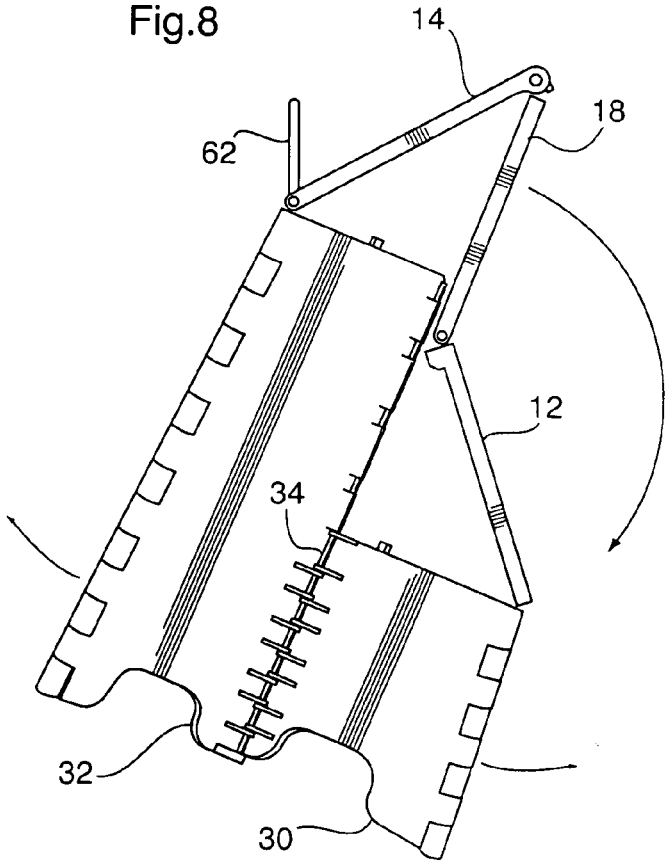
Figure 9:
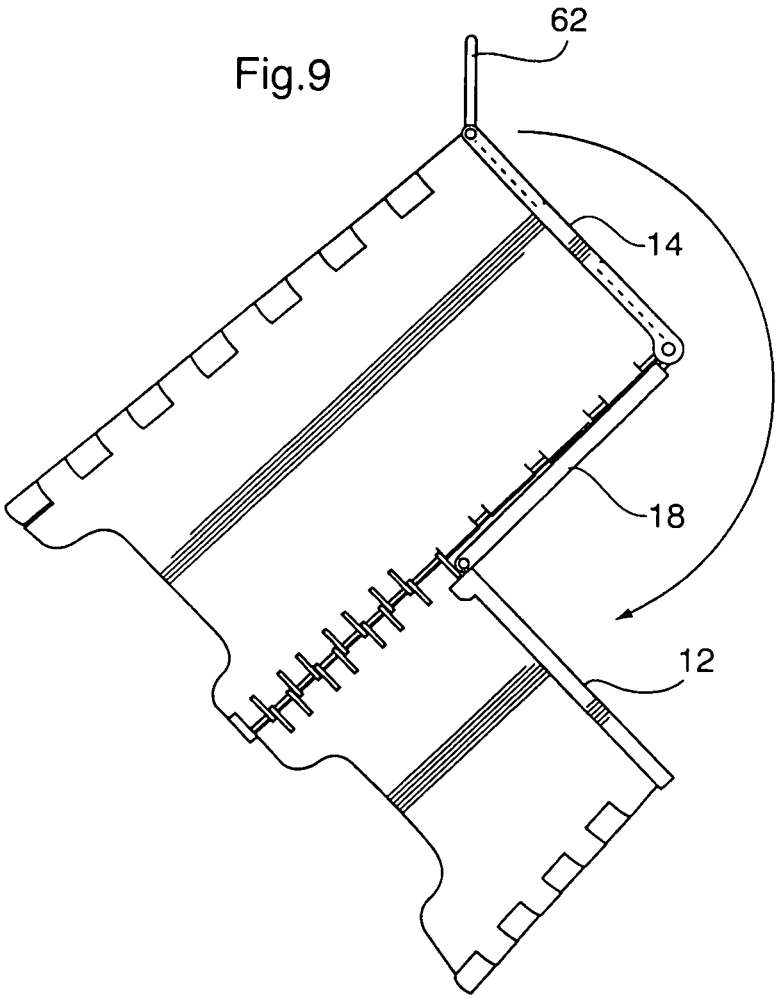

The manner in which the step ladder unfolds to an operative condition is illustrated in FIGS. 7-9. In FIGS. 7 and 8, handle 62 is swung open then raised. Gravity causes upper tread 14 and upper riser 18 to swing clockwise in the direction of the arrow with resulting forward movement of lower tread 12. As the lower tread moves outward, front and back side panels 30, 32 unfold or swing outward about hinge 34 until the angle between them is somewhat less than 180 degrees as is explained in greater detail in the description of FIGS. 12 to 14 below. When the step ladder is righted from the condition illustrated in FIG. 9, it will rest in a stable condition on a horizontal surface and be ready for use.

With reference to FIG. 12, a portion of the underside of the lower tread 12 and hinge 20 is shown in conjunction with a fragmentary view of the front side panel 30 on which the lower tread rests. A fragmentary view of the back side panel 32 is also shown in that Figure. Sections of the two side panel are depicted in FIGS. 13 and 14. In FIG. 13, the side panels are in the condition in which they would be when the step ladder was in an inoperative condition. In that view, the two side panels are parallel to one another.

In FIG. 14, the side panels are in the condition in which they would be when the step ladder was in an operative condition. The outer surfaces 32*a*, 30*a* of the two panels are not co-planar. The angle between them, indicated 90, is less than 180 degrees so that when the step ladder is folding to an inoperative condition, the two side panels will reliably fold or swing inward to the condition shown in FIG. 13. If the angle is 180 degrees or greater, the two side panels may stick in a coplanar condition and resist folding. The angle is adjusted by means of a stop 32*b* on ear 36 (FIG. 1) of side panel 32. The stop abuts against the side wall of side panel 30 when the step ladder is in an operative condition.

The lower riser and rear panel of the step ladder as well as the side panels are canted to minimize the possibility that the ladder may not be open completely when it is lifted by handle 62. It is desirable to minimize this possibility because if the ladder is not completely open when it is stepped on, it may be unstable and even tip over. Canting minimizes the possibility that the step ladder will tip over when the front edge of the lower tread and the side edges of the treads are stepped on as is explained immediately below.

With reference to FIG. 11, lower riser 16 is sloped outward so that feet 42 extend beyond the front edge 12*a* of the lower tread. As a result, the centre of gravity of the step ladder is not beyond the front edge when a user puts his foot on the front edge. The slope of the lower riser, indicated 100, is preferably in the range of about 8 degrees to about 12 degrees, preferably about 8 degrees. That angle is measured when the step ladder is open and resting on a horizontal surface. The angle is between a vertical line 102 at the front edge 12*a* of the tread and the front wall 16*a* of lower riser 16.

Rear panel wall 50 should have a slope similar to that of the lower riser. The angle between vertical line 104 at the rear edge 14*b* of the upper tread and the outer wall 54*b* of the rear panel, indicated 104, is preferably in the range of about 8 degrees to about 12 degrees and more preferably about 8 degrees. The feet 52 of the rear panel should also preferably be beyond the rear edge 14*b* of the upper riser so that the centre of gravity is beyond the rear edge of the foot print of the step ladder when a user steps on the rear edge 14*b* of the upper tread. In that way, the step ladder will not tip over backward if the upper tread is stepped on in this manner The front and rear side wall 30-33 of the step ladder are all sloped outward from top to bottom and again the preferred angle of the slope is in the range of about 8 degrees to about 12 degrees and more preferably about 8 degrees. With reference to FIG. 15, the angle of the slope of front side walls 30, 31 is marked 120*a,b* and is measured between vertical line 122*a,b* and the outer surfaces of the last-mentioned side walls. As well, the feet of the side walls should preferably be outside the side edges of the footprint of the step ladder.

It will be understood that the step ladder described above can have three or more steps. The structure of the step ladder will be similar to that of the two step ladder except that, of course, the ladder will be heavier and therefore will require more strength to lift and accordingly to open and close it.

It will be understood of course that modifications can be made in the structure of the step ladder of the invention without departing from the scope and purview of the invention as covered in the claims that follow.

I claim:

1. A folding step ladder foldable from an operative condition to an inoperative condition, said step ladder including lower and upper treads; an upper riser extending between said treads and pivotal relative to both of said treads, front and back side panels extending downward from opposite sides of said lower and upper treads respectively, said front and back side panels on each side of said treads being pivotal relative to each other; a lower riser pivotal relative to said lower tread and extending downward therefrom, said lower riser being pivotal relative to both of said front side panels; a rear panel pivotal relative to said upper tread and extending downward therefrom, said rear panel being pivotal relative to both of said back side panels, further including forward elevating means for raising said step ladder selectively at a location at which said upper tread pivots about said upper riser, raising of said forward elevating means while said step ladder is in said operative condition causing said front and back side panels on each side of said treads to pivot toward each other while said risers and rear panel advance inward toward each other until said upper riser, lower tread and lower riser form one substantially linear component while said upper tread and said rear panel form a second substantially linear component, said two components being substantially parallel to one another and adjacent thereto such that said step ladder is in said inoperative condition.

2. The folding step ladder of claim 1 further including a strut which extends between said upper riser and said rear panel and is pivotal relative thereto, said strut maintaining said upper riser and said rear panel in a spaced relationship when said step ladder is in said operative position.

3. The folding step ladder of claim 1 wherein said lower and upper treads rest on and are supported by said front and back side panels respectively when said step ladder is in said operative condition.

4. The folding step ladder of claim 1 wherein said step ladder has a footprint defined by feet disposed at the bottom of said lower riser, front and back side panels and said rear panel, said lower riser extending downwardly and outwardly from a forward edge of said lower tread such that said forward edge is vertically above said footprint.

5. The folding step ladder of claim 4 wherein the angle between said lower riser and an imaginary vertical line which passes through said lower riser is in the range of about 8 degrees to about 12 degrees.

6. The folding step ladder of claim 5 wherein said angle is about 8 degrees.

7. The folding step ladder of claim 1 wherein said step ladder has a footprint defined by feet disposed at the bottom of said lower riser, front and rear side panels and said rear panel, said rear panel extending downwardly and outwardly from a rear edge of said upper tread such that said rear edge is vertically above said footprint.

8. The folding step ladder of claim 7 wherein the angle between said rear panel and an imaginary vertical line which passes through said rear panel is in the range of about 8 degrees to about 12 degrees.

9. The folding step ladder of claim 8 wherein said angle is about 8 degrees.

10. The folding step ladder of claim 1 wherein said step ladder has a footprint defined by feet disposed at the bottom of said lower riser, front and back side panels and said rear panel, said front and back side panels each extending downwardly and outwardly from a separate side edge of said lower and upper treads, each said separate said side edge being vertically above said footprint.

11. The folding step ladder of claim 10 wherein the angle between said front and back side panels and an imaginary vertical line which passes through said front and back side panels, respectively, is in the range of about 8 degrees to about 12 degrees.

12. The folding step ladder of claim 11 wherein said angle is about 8 degrees.

13. A folding step ladder foldable from an operative condition to an inoperative condition, said step ladder including lower and upper treads; an upper riser extending between said treads and pivotal relative to both of said treads, front and back side panels extending downward from opposite sides of said lower and upper treads respectively, said front and back side panels on each side of said treads being pivotal relative to each other; a lower riser pivotal relative to said lower tread and extending downward therefrom, said lower riser being pivotal relative to both of said front side panels; a rear panel pivotal relative to said upper tread and extending downward therefrom, said rear panel being pivotal relative to both of said back side panels, further including rear elevating means for raising said step ladder selectively at a location at which said upper tread pivots about said rear panel, raising of said rear elevating means while said step ladder is in said inoperative condition causing said front and back side panels on each side of said treads to withdraw outward away from each other until said step ladder is in said operative condition.

14. A folding step ladder foldable from an operative condition to an inoperative position, said step ladder including a plurality of vertically spaced treads including lowermost and uppermost said treads, an upper riser spaced between adjacent said treads and pivotal relative thereto, side panels extending downward from opposite sides of each said tread including lowermost and uppermost said side panels, each said side panels on each side of said treads being pivotal relative to adjacent said side panel; a lower riser pivotal relative to said lowermost tread and extending downward therefrom, said lower riser being pivotal relative to said lowermost side panels on either side of said lowermost tread; a rear panel pivotal relative to said uppermost tread and extending downward therefrom, said rear panel being pivotal relative to said uppermost side panels on either side of said uppermost tread, further including forward elevating means for raising said step ladder selectively at a location at which said uppermost tread pivots about said upper riser adjacent thereto; raising of said forward elevating means while said step ladder is in said operative condition causing said side panels on each side of said treads to pivot while said upper and lower risers advance inward toward said rear panel until said treads beneath said uppermost tread and said upper and lower risers form one substantially linear component while said uppermost tread and said rear panel form a second substantially linear component, said two components being substantially parallel to one another and adjacent thereto when said step ladder is in said inoperative condition.

15. The folding step ladder of claim 14 further including a strut which extends between an uppermost and upper riser and said rear panel and is pivotal relative to both said upper riser and said rear panel, said strut maintaining the latter said upper riser and said rear panel in a spaced relationship when said step ladder is in said operative condition.

16. The folding step ladder of claim 14 wherein said treads are free to pivot relative to said side panels, said treads resting on and being supported by said side panels when said step ladder is in said operative condition.

17. A folding step ladder foldable from an operative condition to an inoperative position, said step ladder including a plurality of vertically spaced treads including lowermost and uppermost said treads, an upper riser spaced between adjacent said treads and pivotal relative thereto, side panels extending downward from opposite sides of each said tread including lowermost and uppermost said side panels, each said side panels on each side of said treads being pivotal relative to adjacent said side panel; a lower riser pivotal relative to said lowermost tread and extending downward therefrom, said lower riser being pivotal relative to said lowermost side panels on either side of said lowermost tread; a rear panel pivotal relative to said uppermost tread and extending downward therefrom, said rear panel being pivotal relative to said uppermost side panels on either side of said uppermost tread, further including rear elevating means for raising said step ladder selectively at a location at which said uppermost tread pivots about said rear panel, raising said rear elevating means while said step ladder is in said inoperative condition causing said side panels on each side of said treads to pivot away from each other while said risers and said rear panels withdraw outward away from each other until said step ladder is in said operative condition.

* * * * *